US006698618B2

(12) United States Patent
Ramsey

(10) Patent No.: US 6,698,618 B2
(45) Date of Patent: Mar. 2, 2004

(54) DISPENSING CLOSURE

(75) Inventor: Christopher Paul Ramsey, Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/296,047

(22) PCT Filed: May 23, 2001

(86) PCT No.: PCT/GB01/02303

§ 371 (c)(1),
(2), (4) Date: Nov. 21, 2002

(87) PCT Pub. No.: WO01/89948

PCT Pub. Date: Nov. 29, 2001

(65) Prior Publication Data

US 2003/0141323 A1 Jul. 31, 2003

(30) Foreign Application Priority Data

May 25, 2000 (EP) ..... 00304475

(51) Int. Cl.[7] ..... B65D 35/00
(52) U.S. Cl. ..... 222/92; 222/556
(58) Field of Search ..... 222/92, 107, 215, 222/541.6, 556

(56) References Cited

U.S. PATENT DOCUMENTS

| | | | | | |
|---|---|---|---|---|---|
| 4,733,801 | A | * | 3/1988 | Scammell | 222/107 |
| 4,948,015 | A | * | 8/1990 | Kawajiri et al. | 222/107 |
| 5,447,674 | A | * | 9/1995 | Schellenbach | 264/255 |
| 5,913,460 | A | * | 6/1999 | Arciniegas | 222/530 |
| 6,170,705 | B1 | * | 1/2001 | Schneider et al. | 222/92 |

FOREIGN PATENT DOCUMENTS

| | | | | |
|---|---|---|---|---|
| EP | 0351926 | * | 1/1990 | B63D/35/28 |

* cited by examiner

*Primary Examiner*—Gene Mancene
*Assistant Examiner*—Melvin A. Cartagena
(74) *Attorney, Agent, or Firm*—Diller, Ramik & Wight

(57) ABSTRACT

A sequentially moulded closure arrangement (1) comprising a body (4), which forms the shoulder of a container, such as a tube (2), and defines a dispensing passageway, a cover (5), to seal the dispensing passageway, and a fixing ring (7) to join the body to the container. The cover is connected to the body or the fixing ring by a moulded hinge (6) and the cover and fixing ring are sequentially moulded together as an integral moulding, removing the requirement to assemble the cover, body and fixing ring in a separate assembly operation. The arrangement has further advantages relating to cleanliness and ease of dispensing.

16 Claims, 5 Drawing Sheets

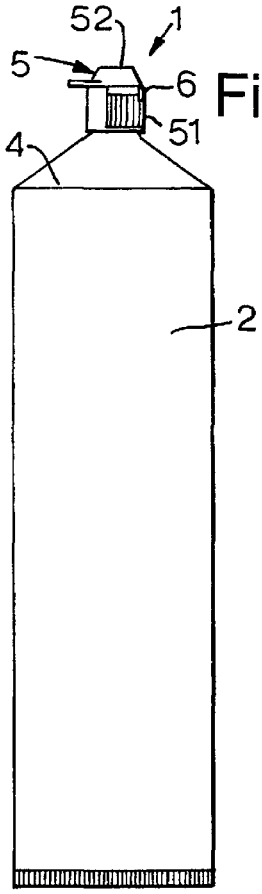
Fig.1.
PRIOR ART
Fig.2.
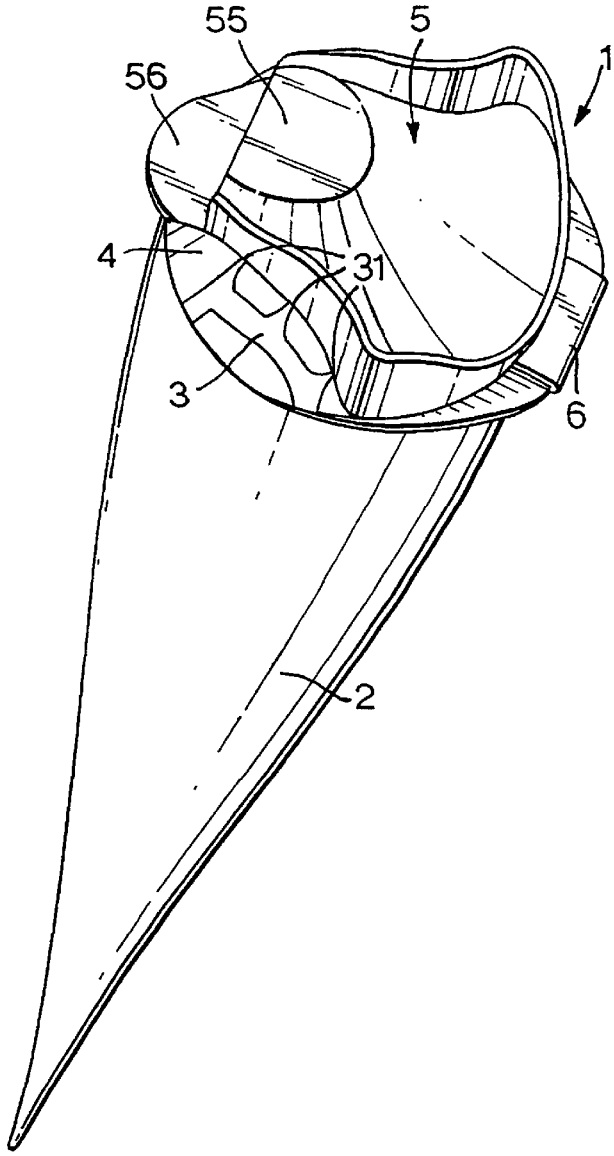

DISPENSING CLOSURE

BACKGROUND OF THE INVENTION

The present invention relates to closure arrangements designed for use with tubes or other containers where the closure body is used to define the neck of the container. Such closure arrangements usually comprise a shoulder portion, which is fixed to one end of the container and defines a dispensing passageway, and a cover portion adapted to seal the dispensing passageway when the container is not in use.

SUMMARY OF THE INVENTION

In particular, the invention relates to a closure arrangement where the shoulder portion is made from a material which cannot be directly bonded to the container, such as a barrier material for example. Traditionally, tube closure arrangements of this type are manufactured from HDPE. Tube shoulders made from HDPE can be directly bonded to the laminate ABL or PBL tubes. However, modern preparations, such as toothpaste for example, require the tube shoulder to be manufactured from a barrier material. Unfortunately such barrier materials will not bond with the laminate tube material. Therefore, in such cases, the closure arrangement further comprises a fixing ring, made from a material which is compatible with the tube laminate material and will bond thereto. The fixing ring is adapted to fit around the periphery of the tube shoulder. Usually, the fixing ring is assembled on the tube shoulder prior to the assembly being sealed into the tube. Because the tube shoulder and fixing ring are made of different materials, which will not bond with each other, it is necessary to provide a mechanical lock between the two components to prevent them from becoming separated.

The material used for the tube shoulder is often not suitable for forming an integral hinge between it and the cover portion. Therefore, if a hinged cover is desired, a separate closure comprising a body and a lid has to be provided, made from a material which is suitable for forming an integral hinge. The closure body is provided with mechanical engagement means, such as screw threads or snap beads, to hold it in place on the tube shoulder, which has cooperating threads or snap engagement means. Thus, a typical hinged tube closure arrangement comprises 3 parts; a tube shoulder, a fixing ring to bond the tube shoulder onto the tube, and a separate hinged closure. The tube shoulder and fixing ring have to be assembled prior to fixing the assembly onto the tube. The separate closure also has to be applied to the neck portion of the tube shoulder.

One aim of the present invention is to remove the requirement for assembly of the closure arrangement by using sequential moulding techniques to mould the shoulder, fixing ring and cover as a single component. Another aim of the invention is to provide a hinged closure arrangement, in which the cover portion is hinged directly to the shoulder or the fixing ring. Yet another aim of the invention is to use this technique to provide tamper-evidence to indicate if the cover has been opened.

Accordingly, the present invention provides a closure assembly comprising a body adapted to form the neck of a container, having a depending skirt and defining a dispensing passageway, a cover arranged to cooperate with the body to seal the dispensing passageway, and a fixing ring arranged around the periphery of the depending skirt for connecting the body to the container, the cover and fixing ring are sequentially moulded over the body, and the cover and fixing ring being moulded integrally with one another, characterised in that the cover is connected to the body or the fixing ring by a sequentially moulded hinge.

The connection of the cover and fixing ring together as a unitary component, which is sequentially moulded around the shoulder, has several advantages. First, there is no need to assemble the various components of the closure arrangement prior to affixing it to the container. Also the connection between the cover and the fixing ring may be-adapted to provide a mechanical key between the fixing ring and the shoulder to prevent them becoming disassociated either prior to or during use.

Advantages of providing a hinge between the cover and the shoulder or the fixing ring include, for example, that the cover is retained on the container and the cover can be pivoted through a large angle and therefore held clear of the dispensing passageway.

A mechanical hinge may be sequentially moulded between the cover and the shoulder to provide a simple, inexpensive hinged closure. The dissimilar materials of the cover and the shoulder means that these components will not bond to one another and the two hinge parts will be able to move relative to one another, thereby allowing the mechanical hinge to operate.

Alternatively, a hinge section may be moulded between the cover and the fixing ring. The advantage of the arrangement according to the invention is that conventional materials may be used for the cover and the fixing ring and hence conventional hinge configurations can be moulded between these components, such as a simple film hinge or snap hinge.

The arrangement of the hinge and the fixing ring has implications for heat sealing the fixing ring to the container. If the hinge is radially inwardly displaced of the fixing ring this allows the use of axial heat sealing equipment. If the hinge is radially outwardly displaced, axial heat sealing is not possible and radial heat sealing must be used. Axial heat sealing is simpler and is generally preferred for such applications.

Advantageously, the cover and the fixing ring are connected by thin sections, which are broken on first opening of the closure to provide visible tamper-evidence. The connection between the cover and the fixing ring may be adapted to provide a mechanical key between the fixing ring and the shoulder. Preferably, the connection between the fixing ring and the cover defines a strap or straps to key the fixing ring and shoulder together to prevent relative movement between the two. The mould cavity for the straps provides a flow path between the cover and the fixing ring to allow the molten plastics material to pass from the cover mould cavity into the fixing ring mould cavity. Preferably the strap or straps are connected to the cover by the thin sections previously described.

As described above, the cover and fixing ring may be connected by thin sections which can easily be broken by a user to allow the cover to be opened. Alternatively, the two components may be connected by thicker portions which have to be cut prior to first opening. Thin sections may be left after the cutting procedure to provide frangible bridges which are broken by the user when the cover is opened for the first time. The latter has the advantage that it is easier to manufacture because the mould will have larger cavities, providing a larger flow path for the molten plastic. However, the former has the advantage that a separate cutting operation is not required.

Many applications require the use of barrier materials to form the shoulder because this part of the closure arrangement is in contact with the product. Hence, the shoulder is preferably produced from a suitable barrier material such as PET or PBT to protect the product, reducing flavour loss and scalping for example. The material used for the fixing ring must be compatible with the material used for container, such as the laminate material used for tubes for example, so that the fixing ring can bond the shoulder onto the container. HDPE is a suitable material for the fixing ring and also has good properties for the cover. For example, it can be used to form conventional hinges and provides a good seal against the dispensing aperture formed in the PET/PBT shoulder, to prevent product leakage.

The present invention will now be described, by way of example only, with reference to the accompanying drawings, in which:

BRIEF DESCRIPTION OF THE DRAWINGS

FIG. 1 shows an external side view of a conventional hinged tube closure arrangement mounted on a tube;

FIG. 2 shows an isometric view of a hinged tube closure arrangement according to the invention mounted on a tube;

DESCRIPTION OF THE PREFERRED EMBODIMENTS

Figure 3:
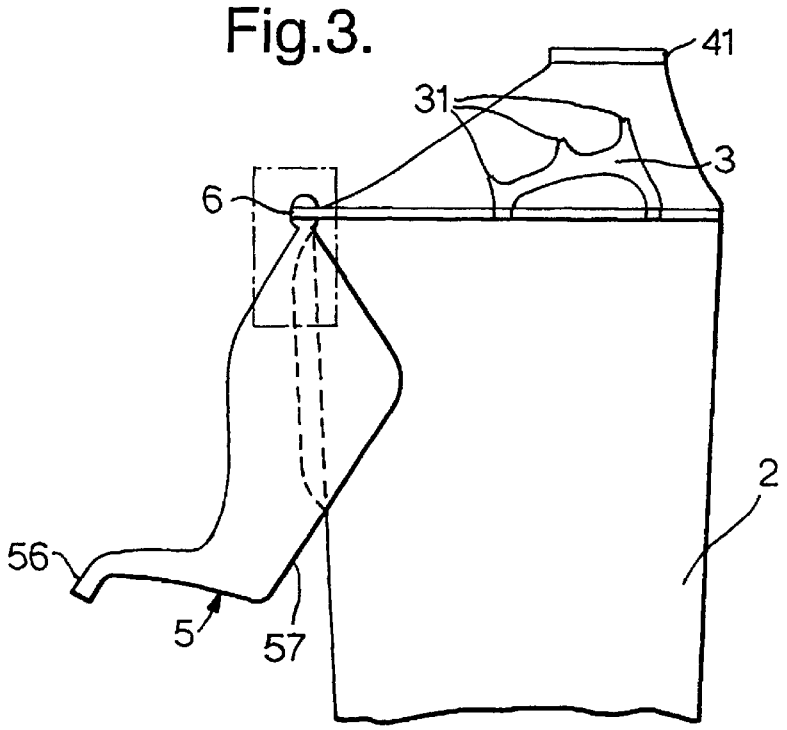
FIG. 3 shows a side view of the tube closure arrangement of FIG. 2 with the cover in its open position.

Wherever possible, like components have been given the same reference numerals.

Referring to FIG. 1, a conventional hinged tube closure arrangement 1, for connection to a tube 2, comprises a tube shoulder 4, preferably made from a barrier material and defining a dispensing nozzle (not shown), and a separate closure cap 5 comprising a body 51 and a top 52 connected together at a hinge 6. The body 51 and dispensing nozzle on the tube shoulder 4 are provided with mutually co-operating screw threads or other engagement means (not shown). Instead of the hinged closure cap 5 shown in FIG. 1, it is also known to provide a conventional screw closure, arranged to cooperate with complimentary screw threads on the dispensing nozzle. Where the tube shoulder 4 is produced from a barrier material, PET or PBT for example, a separate fixing ring (not shown) must also be provided to bond the tube shoulder 4 to the tube 5. Conventionally, this fixing ring is assembled on the tube shoulder 4 and fixed thereto by some form of mechanical key such as a spline or snap bead arrangement. The combined assembly is then joined to the tube 2.

Referring to FIG. 2, a hinged tube closure arrangement 1 according to the invention comprises a tube shoulder 4, which provides the closure body and defines a dispensing nozzle (not shown), and a sequentially moulded cover 5. The shoulder 4 and cover 5 are joined at a mechanical hinge 6 which is formed during the sequential moulding process. The underside of the cover 5 generally conforms to the shape of the shoulder 4 and a seal portion of the cover 55 covers and seals the dispensing nozzle (not shown). A tab 56 is also defined on the cover 5 to enable a user to open the cover 5 and expose the dispensing nozzle.

Straps 3 join the cover 5 to a fixing ring (not shown), which is used to connect the shoulder 4 to the tube 2. The straps 3 are connected to the cover 5 by thin, frangible sections 31, which break upon first opening of the cover. The broken thin sections 31 provide a visible indication that the cover 5 has been opened. The straps 3 restrain the fixing ring on the shoulder 4 and prevent these components from moving relative to one another. Furthermore, the mould cavity for the straps 3 and thin sections 31 provide a flow path for molten plastics material to flow from the cover 5 to the fixing ring (not shown). Therefore, all three components are sequentially moulded together removing the requirement for a separate assembly step in the manufacturing process.

Figure 4:
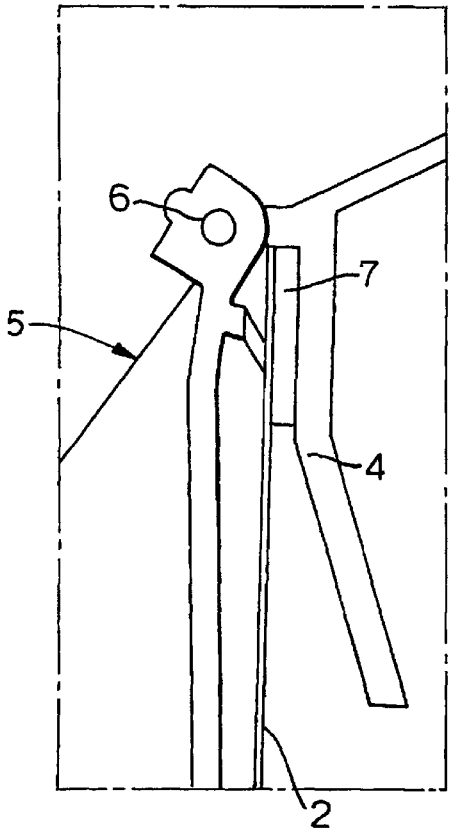
FIG. 4 shows a detailed cross sectional view of the rectangular portion indicated in FIG. 3.

Referring to FIGS. 3 and 4, the cover 5 may be pivoted about the hinge 6 to expose the dispensing nozzle 41 and thereby allow product to be dispensed. As the cap is opened, the thin sections 31 break, giving visible tamper evidence, but the straps 3 remain intact to hold the fixing ring 7 (shown in FIG. 4) and shoulder 4 firmly together. The cover 5 generally conforms to the shape of the dispensing nozzle 41 but also defines a peripheral rim 57 upon which the tube 2 can stand when the cover 5 is in its closed position. Preferably, the peripheral rim 57 is shaped to define a recess, which accommodates the side of the tube 2 when the cover 5 is pivoted to its fully open position. This recess means that the cover 5 can be pivoted through a large angle (approximately 200° or more as shown in FIG. 3) and therefore the cover 5 may be held clear of the dispensing nozzle 41 allowing unimpeded dispensing of the product. This has the benefit that the closure arrangement can be kept substantially free of product spills and can therefore be kept cleaner.

The mould cavity for the strap 3 allows molten plastic to pass from the cover 5 mould cavity to the mould cavity for the fixing ring 7; in other embodiments the connecting flow path between the cover and the fixing ring can be arranged to provide a hinge. The fixing ring 7 is made from a compatible material to the laminated tube 2, such as HDPE for example, and allows the shoulder 4 to be bonded to the tube 2 as shown in FIG. 4.

Figure 5:
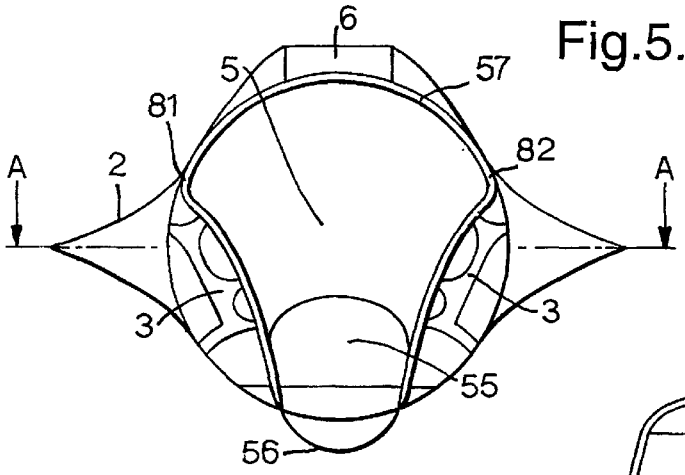
FIG. 5 shows a plan view of the closure according to the invention with the cover in its closed position.
Figure 6:
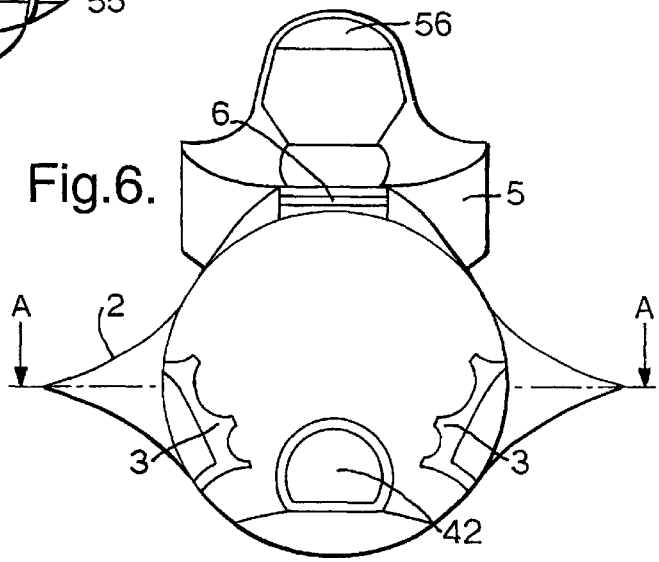
FIG. 6 shows a plan view of the closure shown in FIG. 5 with the cover in its open position.

FIGS. 5 and 6 show plan views of the closure according to the invention with the cover in its closed and open positions respectively. The rim 57 around the periphery of the cover 5 provides two feet 81 and 82, which together with dispensing nozzle portion of the cover 55, define a 3 point contact, which allows the tube to be supported in an upright position using the cover 5 as a base. The area between the feet 81 and 82, adjacent to the hinge 6 is recessed to allow the cover 5 to be pivoted through an angle of approximately 180° or more as shown in FIG. 6.

Figure 7:
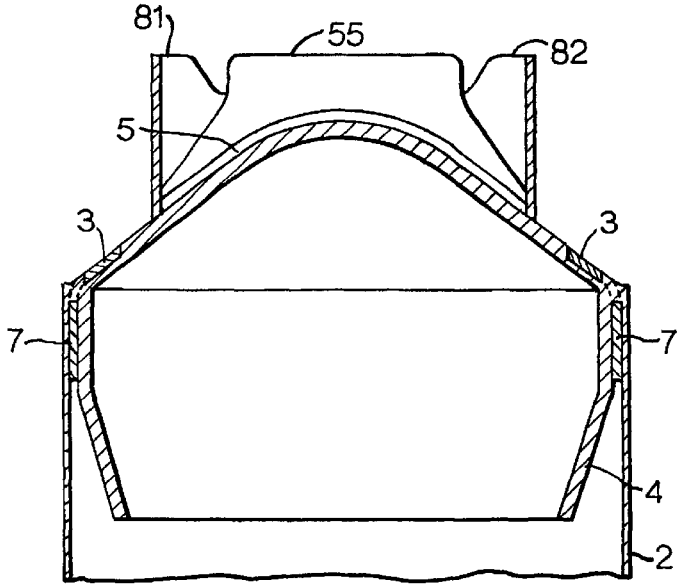
FIG. 7 shows a cross sectional view of the closure shown in FIGS. 5 and 6 along the line A—A with the cover in its closed position, looking in the direction indicated by the arrows.

FIG. 7 clearly shows the three "feet" 81, 82 and 55 upon which the tube may stand in an upright position, and also shows the flow path (dashed lines) between the straps 3 and the fixing ring 7.

Referring to FIGS. 3, 5 and 6, the dispensing nozzle 41 is preferably located off centre (see A—A in the plan views of the closure arrangement 1 in FIGS. 5 & 6) as far away from the hinge 6 as possible. This arrangement has a number of advantages. As already described, the nozzle 41 and seal portion 55 of the cover forms a "foot" which acts in combination with the other feet 81, 82 to provide a stable base upon which the tube 2 can stand in an upright position. However, more importantly, this positioning of the dispensing nozzle makes it more accessible and allows more convenient and accurate dispensing of the product than conventional closure arrangements where the dispensing nozzle is centred on the shoulder (see FIG. 1). Additionally, as shown in FIGS. 5 and 6, the dispensing nozzle 41 defines a circular dispensing orifice 42, flattened along one side. This flattened side gives the exuded product a flattened base. Using a tube of toothpaste as an example, this flattened base means that the exuded toothpaste will sit on a toothbrush without rolling off. Such a nozzle profile is only possible by use of sequential moulding. In conventional closures, the nozzle has to have a circular profile to enable the cover to form a bore seal with the nozzle. In the case of sequential moulding, the cover forms a sealing portion which contracts around the nozzle as it cools, forming a fluid tight seal. The sealing portion on the cover therefore conforms to the shape of the nozzle forming a tight seal regardless of the nozzle profile.

Figure 8A:
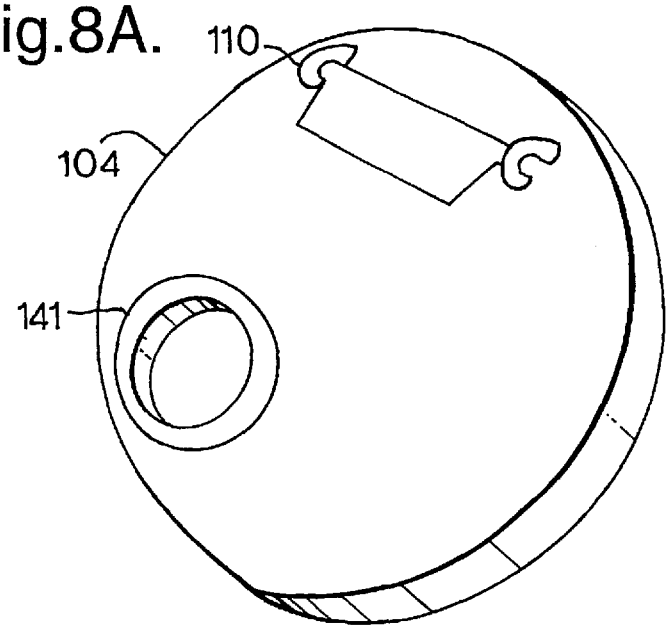
FIG. 8A is a perspective view of a shoulder formed as part of an alternative embodiment.
Figure 8B:
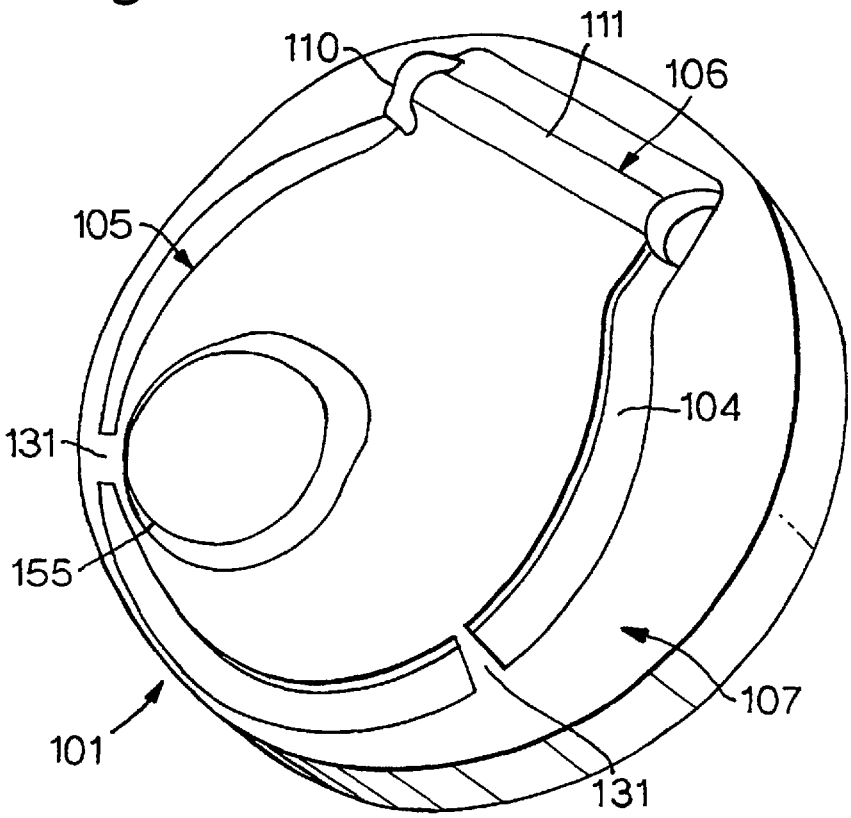
FIG. 8B is a perspective of the shoulder of FIG. 8*a* shown as part of a closure assembly.

Referring to FIGS. 8*a* and 8*b* there is shown an alternative embodiment. In this embodiment the cover 105 is connected to the shoulder 104 by a mechanical hinge 106. The hinge 106 comprises two spaced lugs 110 on the shoulder which receive a pin member 111 formed as part of the cover 105. In this embodiment it can be seen that the hinge 106 is radially inwardly displaced of the fixing ring 107. This arrangement allows the fixing ring 107 to be heat sealed onto a container (not shown) using axial heat sealing.

Figure 9:
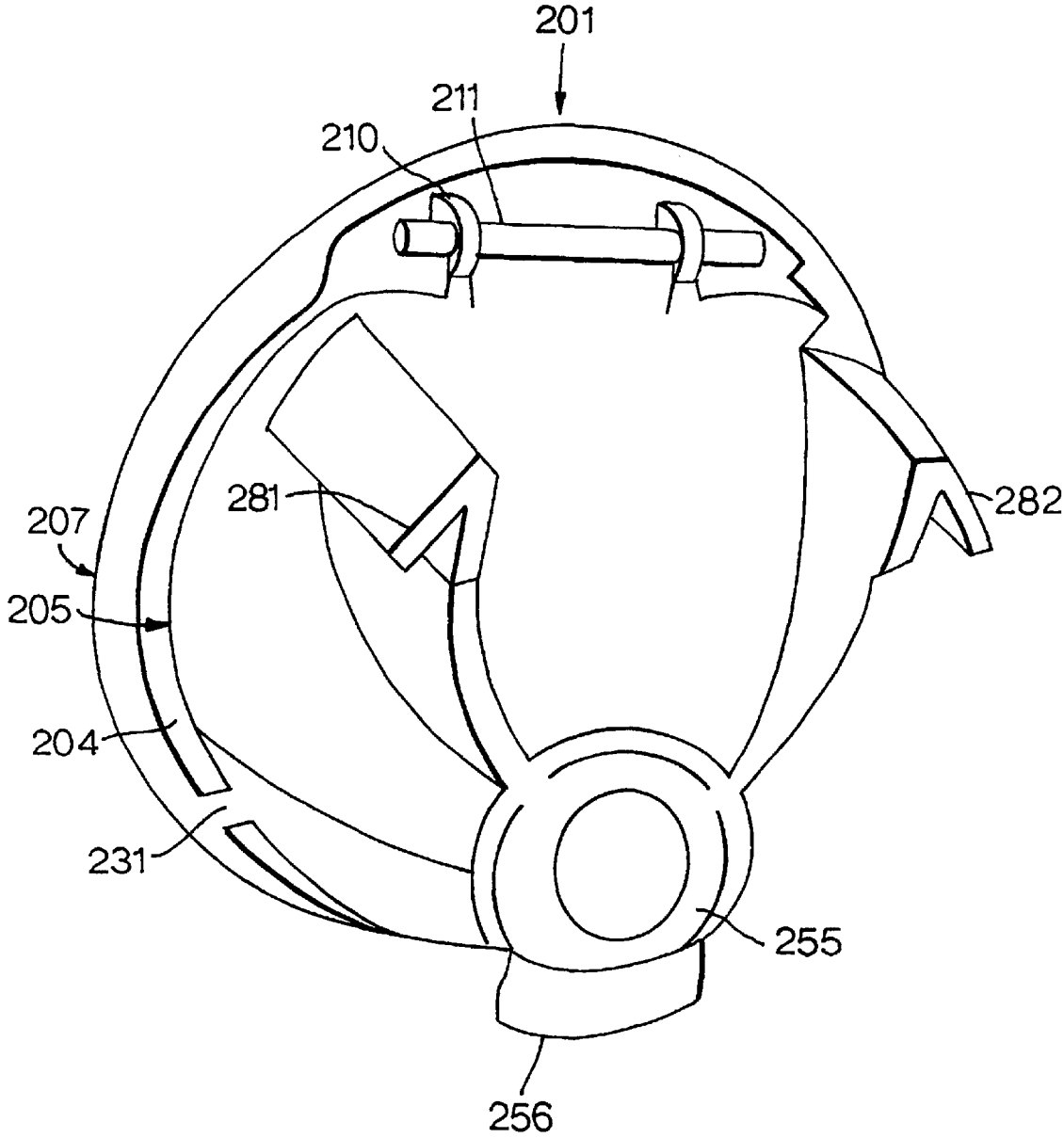
FIG. 9 is a frontal perspective view of a further embodiment.

Referring to FIG. 9 there is shown a closure 201 of the same general construction as shown in FIG. 8*b*. In this embodiment, as in the embodiment shown in FIGS. 5 to 7, the cover 205 provides two feet 281, 282; which together with the dispensing nozzle sealing portion 255 provides a stable base. The base allows a container subsequently bonded to the closure to be supported in an upright position. The area between the feet 281, 282 is recessed to allow the cover 205 to be pivoted through an angle of approximately 150°.

Finally, although the closure has been specifically described in relation to a closure for a tube, the closure according to the invention may equally be applied to a pouch or other such container.

Many variations of the above invention will be apparent to those skilled in the art. It will be understood that the dispensing nozzle does not need to be provided off-centre, nor is the closure required to provide a base upon which the tube or container can stand in an upright position. The peripheral rim around the closure may be removed or may be adapted to provide more "feet" or a partial circular rim upon which the tube can stand. The connecting flow path between the cover and the fixing ring may be modified to pass around the external periphery of the tube and may be adapted to provide a hinge, which may take the form of a film hinge or snap hinge.

Although a preferred embodiment of the invention has been specifically illustrated and described herein, it is to be understood that minor variations may be made in the apparatus without departing from the spirit and scope of the invention, as defined by the appended claims.

What is claimed is:

1. A closure assembly (1, 101, 201) comprising a body (4) adapted to form the neck of a container (2) having a depending skirt and defining a dispensing passageway, a cover (5, 205) arranged to cooperate with the body to seal the dispensing passageway, a fixing ring (7, 207) arranged around the periphery of the depending skirt for connecting the body to the container the cover and fixing ring being sequentially molded over the body, the cover and fixing ring being moulded integrally with one another, and the cover being connected to one of the body and the fixing ring by a moulded hinge (6).

2. The closure assembly (1) as defined in claim 1 wherein the hinge is a sequentially molded mechanical hinge (6).

3. The closure assembly (1) as defined in claim 2 wherein the hinge (6) is radially inwardly displaced of the fixing ring (7).

4. The closure assembly (1) as defined in claim 1 wherein the hinge (6) is radially inwardly displaced of the fixing ring (7).

5. The closure assembly (1) as defined in claim 1 wherein the cover (5) provides a stable base upon which the container (2) can stand.

6. The closure assembly (1) as defined in claim 5 wherein the stable base is provided by a plurality of foot portions (81, 82, 55).

7. The closure assembly (1) as defined in claim 1 wherein the body (4) includes a nozzle portion (41), the nozzle portion defining an orifice (42) having at least one flat.

8. The closure assembly (1) as defined in claim 7 wherein the stable base is defined by a plurality of foot portions (81, 82, 55) and one of the foot portions (55) covers the nozzle portion (41).

9. The closure assembly (101) as defined in claim 8 wherein the nozzle portion (141) is displaced from the centre of the body (104) away from the hinge (106).

10. The closure assembly (101) as defined in claim 7 wherein the nozzle portion (141) is displaced from the centre of the body (104) away from the hinge (106).

11. The closure assembly (1) as defined in claim 1 wherein the cover (5) is shaped to allow it to pivot through an angle of-at least approximately 200°.

12. The closure assembly (101) as defined in claim 11 wherein the nozzle portion (141) is displaced from the centre of the body (104) away from the hinge (106).

13. The closure assembly (1) as defined in claim 1 wherein the cover (5) is shaped to allow it to pivot through an angle of at least approximately 150°.

14. The closure assembly (101) as defined in claim 13 wherein the nozzle portion (141) is displaced from the centre of the body (104) away from the hinge (106).

15. The closure assembly (201) as defined in claim 1 wherein the cover (205) and fixing ring (207) are connected by thin sections (231) which are adapted to break when the cover (205) is opened for the first time.

16. The closure assembly (1) as defined in claim 1 wherein the fixing ring (7) further includes at least one strap (3) which passes through the body (4) and is adapted to hold the fixing ring (7) and the body (4) together.

* * * * *